US006718921B2

(12) United States Patent
Grewal et al.

(10) Patent No.: US 6,718,921 B2
(45) Date of Patent: Apr. 13, 2004

(54) METHOD AND APPARATUS FOR CLEANING AN OIL CONTROL VALVE FOR AN INTERNAL COMBUSTION ENGINE

(75) Inventors: Amanpal S. Grewal, Novi, MI (US); Daniel Lee McKay, Brighton, MI (US); Daniel George Gauthier, Clarkston, MI (US); James Patrick Waters, Waterford, MI (US); Jeffrey M. Pfeiffer, Walled Lake, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/195,614

(22) Filed: Jul. 15, 2002

(65) Prior Publication Data

US 2004/0007195 A1 Jan. 15, 2004

(51) Int. Cl.[7] ..... F01L 1/34

(52) U.S. Cl. ..... 123/90.15; 123/90.12; 123/90.33; 123/196 A

(58) Field of Search ..... 123/90.12, 90.15–90.17, 123/90.33, 196 A, 196 S, 198 D, 198 E, 343, 352; 137/238

(56) References Cited

U.S. PATENT DOCUMENTS

| | | | | |
|---|---|---|---|---|
| 4,531,369 | A | 7/1985 | Izumi | 60/456 |
| 5,971,889 | A | 10/1999 | Ohashi | 477/149 |
| 6,233,922 | B1 | 5/2001 | Maloney | 60/276 |
| 6,293,267 | B1 | 9/2001 | Smith et al. | 123/568.22 |
| 6,315,692 | B1 | 11/2001 | Takahashi et al. | 475/116 |
| 6,367,462 | B1 | 4/2002 | McKay et al. | 123/568.21 |
| 6,401,853 | B1 | 6/2002 | Turski et al. | 180/197 |
| 6,422,189 | B1 | 7/2002 | Pierik | 123/90.24 |
| 6,439,176 | B1 | 8/2002 | Payne et al. | 123/90.12 |
| 6,499,451 | B1 | 12/2002 | Hendriksma et al. | 123/90.16 |
| 6,535,809 | B1 | 3/2003 | Beyer et al. | 701/84 |
| 6,588,394 | B2 | 7/2003 | Zheng | 123/198 F |
| 6,588,409 | B2 | 7/2003 | Maloney et al. | 123/686 |
| 6,615,129 | B2 | 9/2003 | Kabasin | 701/110 |
| 6,622,691 | B2 | 9/2003 | Bagnasco et al. | 123/295 |

OTHER PUBLICATIONS

JP Publication No. 2002–021590, Tomoyuki et al., Jan. 23, 2002, Mazda Motor Corp, "Valve Timing Control Device".*

JP Publication No. 11–350991, Hideki et al., Dec. 21, 1999, Mazda Motor Corp, "Controller of Engine with Variable Valve Timing Device".*

JP Publication No. 09–195805, Masaaki et al., Jul. 29, 1997, Denso Corp, "Valve Timing Adjuster for Internal Combustion Engine".*

SAE 960584 "Comparison of Variable Camshaft Timing Strategies" by T.G. Leone, et al 1996.

SAE 2002–01–1101 "Phasing Strategy for an Engine with Twin Variable Cam Timing" by U. Kramer et al 2002.

* cited by examiner

*Primary Examiner*—Thomas Denion
*Assistant Examiner*—Kyle Riddle
(74) *Attorney, Agent, or Firm*—Jimmy L. Funke

(57) ABSTRACT

The present invention is a method and apparatus to clean an oil control valve for use by an internal combustion engine. The invention causes the oil control valve to execute a cleaning routine when specific entrance criteria are met. This ensures cleaning of the valve to remove contaminants that are wedged, pinched or otherwise trapped on the valve, without interference in the operation of the engine.

25 Claims, 3 Drawing Sheets

METHOD AND APPARATUS FOR CLEANING AN OIL CONTROL VALVE FOR AN INTERNAL COMBUSTION ENGINE

INCORPORATION BY REFERENCE

Applicant incorporates by reference U.S. Pat. No. 6,367,462, entitled Engine Torque Management Method with High Dilution EGR Control, issued to McKay, et al., in that the method for engine torque management need not be fully described in detail herein.

TECHNICAL FIELD

This invention pertains generally to oil control valves for use in internal combustion engines, and more specifically to a method and apparatus to clean an oil control valve.

BACKGROUND OF THE INVENTION

Engine manufacturers have incorporated oil control valves to operate and control actuators that are part of systems for variable cam phasing, cylinder deactivation, and variable valve lift and duration, among others. A system will use the oil control valve to divert flow of pressurized engine oil and drive the actuator to accomplish a desired work output. By way of example, an oil control valve used in conjunction with a variable cam phaser can be used to accomplish variable opening time of an intake or exhaust valve, relative to a position of a piston. The system uses the oil control valve to control the flow of engine oil to the variable cam phaser that is attached to a camshaft of the engine, based upon a command from an engine controller. Distinct engine performance benefits that are realized from the use of variable cam phasing include an improvement in combustion stability at idle, improved airflow into the engine over a range of engine operations corresponding to improvements in engine performance, and improved dilution tolerance. This will result in such benefits as improved fuel economy, improved torque at low engine speeds, lower engine cost and improved quality through elimination of external exhaust gas recirculation (EGR) systems, and improved control of engine exhaust emissions.

The oil control valve has a fluid control portion that is driven by an electromagnetic solenoid. The fluid control portion of the oil control valve is comprised of a valve body and an internal spool. There are two separate openings in the valve body that are in fluid connection with two separate sides of the variable cam phaser. The internal spool has an oil inlet and two separate outlets that correspond to and overlap with the two openings in the valve body. Pressurized engine oil flows through the valve to the two sides of the variable cam phaser.

The oil control valve operates by controlling the amount of the overlap between the openings in the valve body and the spool. This controls the relative flow of oil out of each of the two separate openings to the variable cam phaser. The control of the relative flow controls the relative pressures on each side of the variable cam phaser, which determines the position of the phaser and hence the event timing of the engine valves.

There is a possibility that the performance of the variable cam phasing system will be reduced due to the inability of the oil control valve to control flow and pressure to the two sides of the phaser. This loss of control can be a result of some form of contamination of the valve by engine oil. A typical engine oil filtering system will remove particle sizes above 25 microns in diameter. Particles contained in the oil that are smaller than 25 microns will pass freely with the oil. In most areas of engine operation, this has not proven to be a problem in-use. However, in an oil control valve, contaminants can become pinched between the spool and the valve body, wherein the contaminants become caught in a scissors-like action between a land opening in the spool and a metering edge on the valve body. Also, manufacturing clearances between a valve body and inner spool of the oil control valve are typically much less than 100 microns. Contaminants in the oil may become wedged between the spool and valve body. Either of the actions of pinching or wedging can result in a reduction in response time of the valve or a reduction in the range of motion of the valve, with a corresponding reduction in the valve's ability to control flow to the variable cam phaser. When this happens, the benefits derived from a variable cam phasing system may be compromised by the reduction in valve performance.

The prior art with respect to cam phasing has addressed flow and reduced performance issues by making the grooves in the oil control valve larger than needed to ensure adequate flow to through the valve. This action can reduce dynamic flow control range of the valve. In analogous situations, such as when the valve control system was used in an automatic transmission, the prior art has employed dithering methods, i.e. induced oscillations of a valve at a preset frequency and amplitude, to vibrate the valve to remove grit. Dithering of sufficient amplitude to clean a valve under some operating conditions of an automatic transmission can lead to unacceptable vibration in a clutch or gear shift-shock. Manufacturers of hydraulic propulsion systems have used flush systems to clean and cool hydraulic fluid. The flush system will have high pressure on one side of the valve and a drain to a reservoir on the other side of the valve. The flush system allows flow of a quantity of fluid over the valve to perform a cleaning action.

Hence, there is a need for a method to perform cleaning actions on an oil control valve used in an internal combustion engine to maintain sufficient oil flow and pressure over the life of the engine. There is also a need to perform the cleaning action in a manner that will not disrupt engine operation. Maintaining sufficient flow through the oil control valve will help ensure the ability of an engine system that uses an oil control valve to function as intended to maintain flow control over the range of operation, in order to derive the benefits of the system. Any cleaning method must be transparent to the vehicle operator, in that there should be no deterioration in engine operating performance when the method is actuated. There is also a need to operate the cleaning method in response to the detection of a fault, and in response to an external service command.

SUMMARY OF THE INVENTION

The present invention is an improvement over conventional engine systems that employ oil control valves in that it provides a method to clean the oil control valve by actuating the valve when specific entrance criteria are met. This will ensure on-going cleaning of the valve to remove contaminants that are wedged, pinched or otherwise trapped on the valve without interference in the operation of the vehicle.

The invention removes contaminants from an oil control valve in an internal combustion engine. It includes providing the engine with the oil control valve, at least one sensor, a controller, a fuel injection system, a fault detection system, and an external communicator. The invention determines when the engine is operating in a predetermined mode, and executes an oil control valve cleaning routine at that time.

Some of the specific predetermined modes include the engine operating in a deceleration fuel cutoff mode, an active cleaning mode, a service mode, or an engine-off mode. Obviously other opportune modes may occur to one skilled in the art. The oil control valve cleaning routine comprises cycling the oil control valve over its range of operating positions at least once. This allows a regular flow of oil across the valve over its entire range of operating positions to flush and purge, thus forestalling a build-up of any contaminants during the life of the engine.

A preferred aspect of the invention includes a method for removing contaminants from an oil control valve used in a variable cam phasing system of an internal combustion engine.

Another aspect of the invention contemplates a controller for an oil control valve for use in an internal combustion engine. The controller is operable to execute an oil control valve cleaning routine when it is determined that the engine is operating in a predetermined mode. These and other objects of the invention will become apparent to those skilled in the art upon reading and understanding the following detailed description of the embodiments.

BRIEF DESCRIPTION OF THE DRAWINGS

The invention may take physical form in certain parts and arrangement of parts, and methods to control the parts. The preferred embodiment of the invention will be described in detail and illustrated in the accompanying drawings which form a part hereof, and wherein.

DETAILED DESCRIPTION OF AN EMBODIMENT OF THE INVENTION

Figure 1:
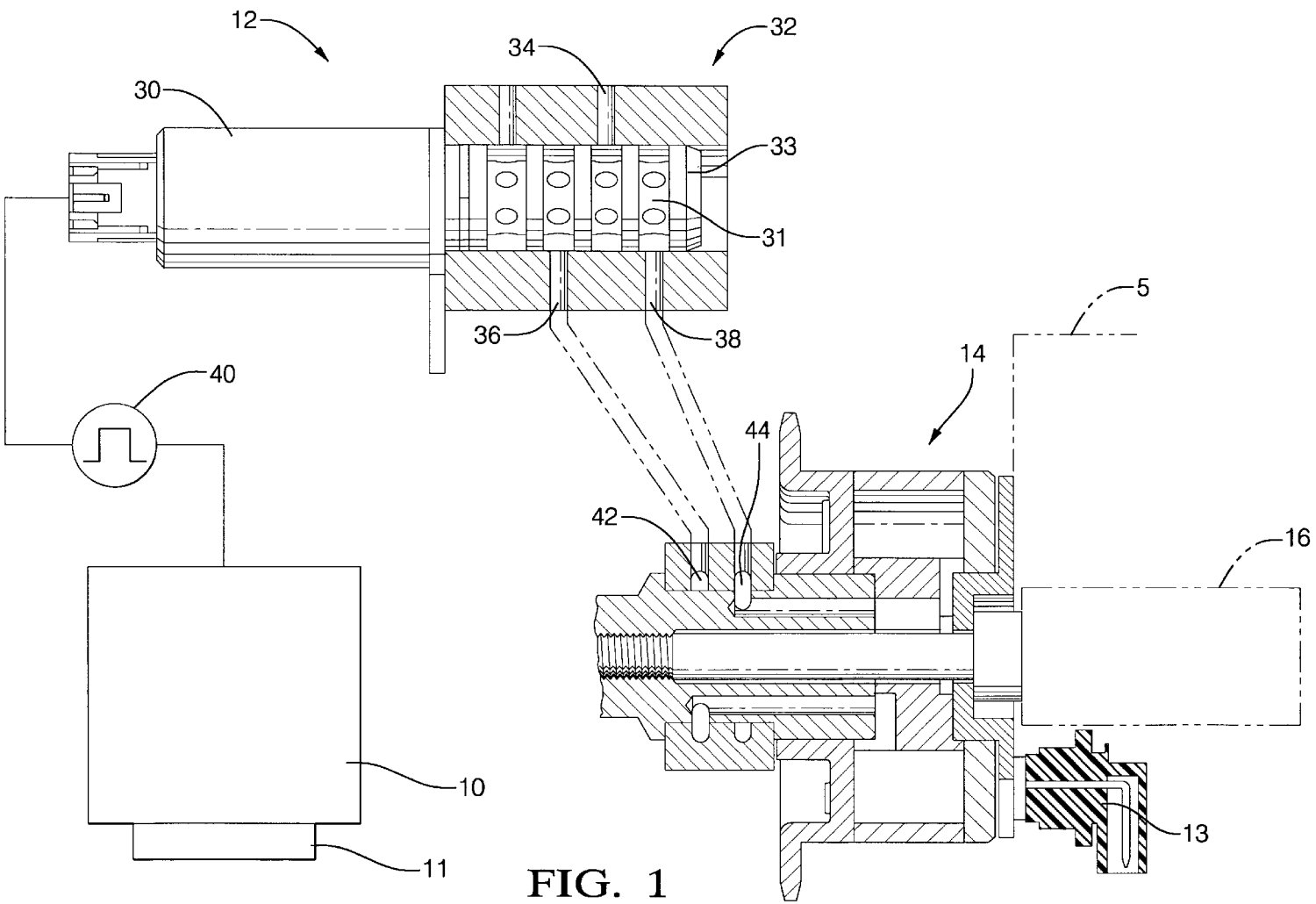
FIG. 1 is a schematic diagram of a variable cam phasing system, in accordance with the present invention.

Referring now to the drawings, wherein the showings are for the purpose of illustrating an embodiment of the invention only and not for the purpose of limiting the same, FIG. 1 shows an internal combustion engine 5 and controller 10 which has been constructed in accordance with an embodiment of the present invention. There is an actuator, which is a variable cam phaser 14 that is controlled by an oil control valve 12. The engine 5 has at least one camshaft 16 with the variable cam phaser 14 attached thereto and a cam position sensor 13. The cam phaser 14 is fluidly connected to an oil control valve 12, which in turn is fluidly connected to a supply of oil from the engine 5 that is pressurized. The controller 10 is operably connected to an engine torque management system (as described in U.S. Pat. No. 6,367,462, entitled Engine Torque Management Method with High Dilution EGR Control, issued to McKay, et al., and is incorporated by reference herewith). The controller 10 is also operably connected to at least one sensor that is used to monitor engine operation. The engine torque management system may comprise a fuel injection system, an ignition system, an electronic throttle control system, an exhaust gas recirculation system, an evaporative control system (not shown), and the variable cam phaser 14 with the oil control valve 12. The at least one sensor may comprise an engine speed sensor, a manifold absolute pressure sensor, a throttle position sensor, an oxygen sensor, intake air sensor, mass air flow sensor, EGR position sensor, exhaust pressure sensor, exhaust gas sensor, torque sensor, combustion sensor, or others (not shown), or the cam position sensor 13. The controller 10 will collect information from the sensors and control output systems, including the engine torque management system, using control algorithms and calibrations internal to the controller 10.

The controller 10 also has a fault detection system (not shown) that monitors the sensors and output systems and determines when a fault may occur. The fault detection system will typically be an on-board diagnostic system that has been designed and developed to meet various governmental regulatory requirements for emissions. The engine 5 with the variable cam phaser 14, the controller 10, and the fault detection system referred to hereinafter are well known to those skilled in the art.

The controller 10 also has an external communicator 11 for sending and receiving electronic information during assembly, testing, and servicing the engine 5. The external communicator 11 is operable to send engine operating conditions and the presence or absence of engine faults from the controller 10 to an external device (not shown), and will receive control signals from the external device. The external communicator 11 can comprise an electrical connector that permits communication from the controller 10 to the external device, such as a handheld scan tool (not shown), using data communications protocols, as is well known to one skilled in the art. One such electrical connector is described in a Society of Automotive Engineers specification, titled SAE Standard J1962—Diagnostic Connector. This specification defines functional requirements for a connector, including design, terminal assignments, electrical interface requirements, and location. Communications protocols can be described by specifications such as SAE Standard J1850—Class B Data Communications Network Interface.

Again referring to FIG. 1, the oil control valve 12 is comprised of an electromagnetic solenoid 30 and a valve 32. The valve is a spool valve 32 with a single inlet 34 of oil and two outlets of oil 36, 38. There is a spool 31 that is attached to an armature (not shown) of the electromagnetic solenoid 30, and the spool 31 is contained within a valve body 33. The spool 31 is contained within the valve body 33, and is coaxial to and is operable to move linearly along the longitudinal axis of the body 33. Each of the two outlets 36, 38 of oil is attached to one of the inlets of the cam phaser 14, as described above. In this embodiment, the electromechanical solenoid 30 is driven by a pulsewidth-modulated ('PWM') signal 40 sent from the controller 10. In operation, a PWM signal 40 is sent to the electromagnetic solenoid 30 and causes the armature (not shown) and attached spool 31 to move linearly along the longitudinal axis within the valve body 33. The position of the spool 31 in conjunction with the designs of the spool 31 and the valve body 33 will determine a relative amount of oil that will flow through the valve 32 from the fluid inlet 34 to each of the two fluid outlets 36, 38. The oil control valve 12 is designed to provide sufficient oil flowrate through the valve 32 so that the response time of the cam phaser 14 and corresponding combustion efficiency of the engine 5 can be optimized at typical oil pressures, temperatures and voltage levels. Flow through the oil control valve 12 will be affected by operating conditions that include inlet and outlet pressure, operating temperature, and voltage and frequency of the PWM signal 40. The design and application of electromechanical spool valves for fluid and pressure control are well known to those skilled in the art.

Figure 2:
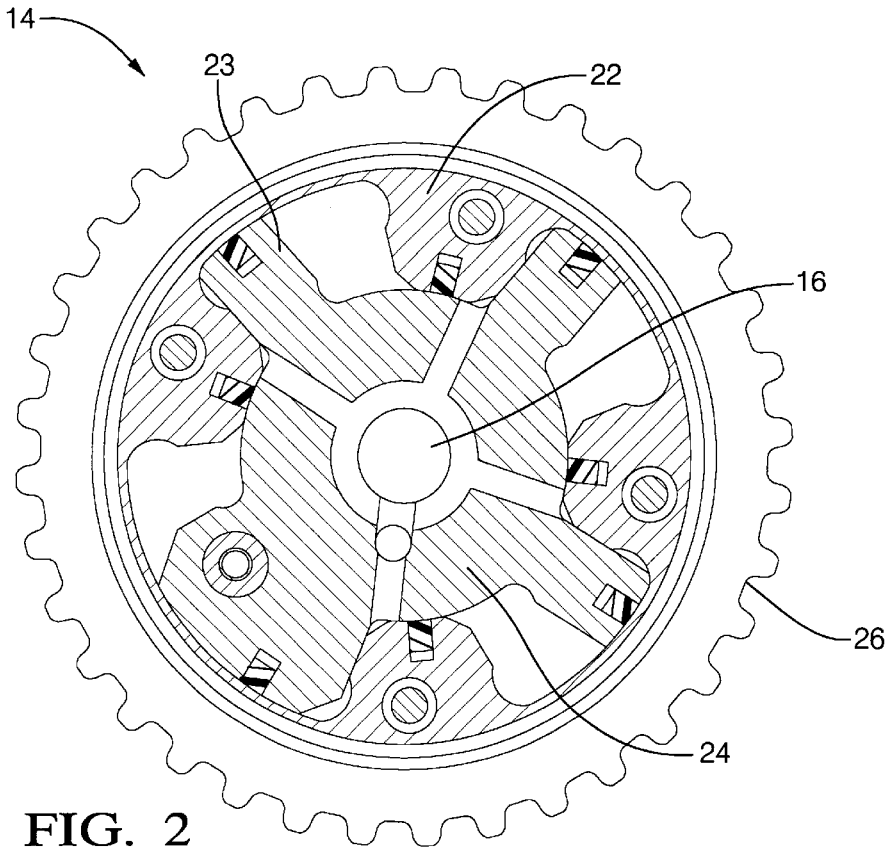
FIG. 2 is a cross-sectional view of an oil control valve, in accordance with the present invention.

FIG. 2 of this embodiment shows the cam phaser 14, which is comprised of a stator 22 and internal rotor 24. The internal rotor 24 is operably attached to the camshaft 16, has one or more rotor vanes 23, and is coaxial to the longitudinal axis of the camshaft 16. The rotor 24 fits inside the stator 22, which is also coaxial with the longitudinal axis of the camshaft 16. The rotor 24 is driven by a pulley 26 attached to a crankshaft (not shown) of the engine 5 using a belt drive or chain drive (not shown). The rotor 24 contains fluid inlets 42, 44 that allow flow of oil to each side of each rotor vane 23. There are also seals and drains in the stator 22 to maintain pressure and allow flow of oil for cooling and lubrication. Each of the fluid inlets 42, 44 of the rotor 24 is in fluid communication with the outlets 36, 38 from the oil control valve 12.

In operation, the stator 22 will be driven by the rotation of the engine crankshaft (not shown) via the belt drive or chain drive. The rotation of the stator 22 will cause the rotor 24 to rotate, which will in turn rotate the camshaft 16, which will cause the engine valves to open and close according to a preset pattern. The controller 10 will send a PWM control signal 40 to the oil control valve 12, which will move the spool 31 in response, thus permitting a flow of oil through the valve 12 to each of the outlets 36, 38. The oil will flow to each side of the vanes 23 on the rotor 24 of the cam phaser 14, and the position of the stator 22 relative to the rotor 24 will change in relation to the relative pressure on rotor 24, the rotation of the stator 22 and the camshaft 16, and other factors. By controlling the position of the rotor 24 in the stator 22 of the cam phaser 14, the controller 10 can control the opening and closing of an intake or exhaust valve relative to the position of the engine crankshaft and a corresponding piston (not shown). Again, this is well known to one skilled in the art.

Referring again to FIG. 1, the controller 10 for the oil control valve 12 for use in the internal combustion engine 5 is shown. The controller 10 determines that the internal combustion engine 5 is operating in a predetermined mode based upon input from the fuel injection system (not shown), at least one sensor and an external communicator 11. The controller 10 then executes an oil control valve cleaning routine based upon determination of the predetermined mode. The predetermined mode can be a predetermined engine operating condition such as a deceleration fuel cutoff mode, or it can be when a fault has been detected by the fault detection system. The predetermined mode can also be when there has been an external request for active cleaning using the external communicator 11, or it can be when the engine 5 is being shutdown, or when the engine has been shutdown.

Figure 3:
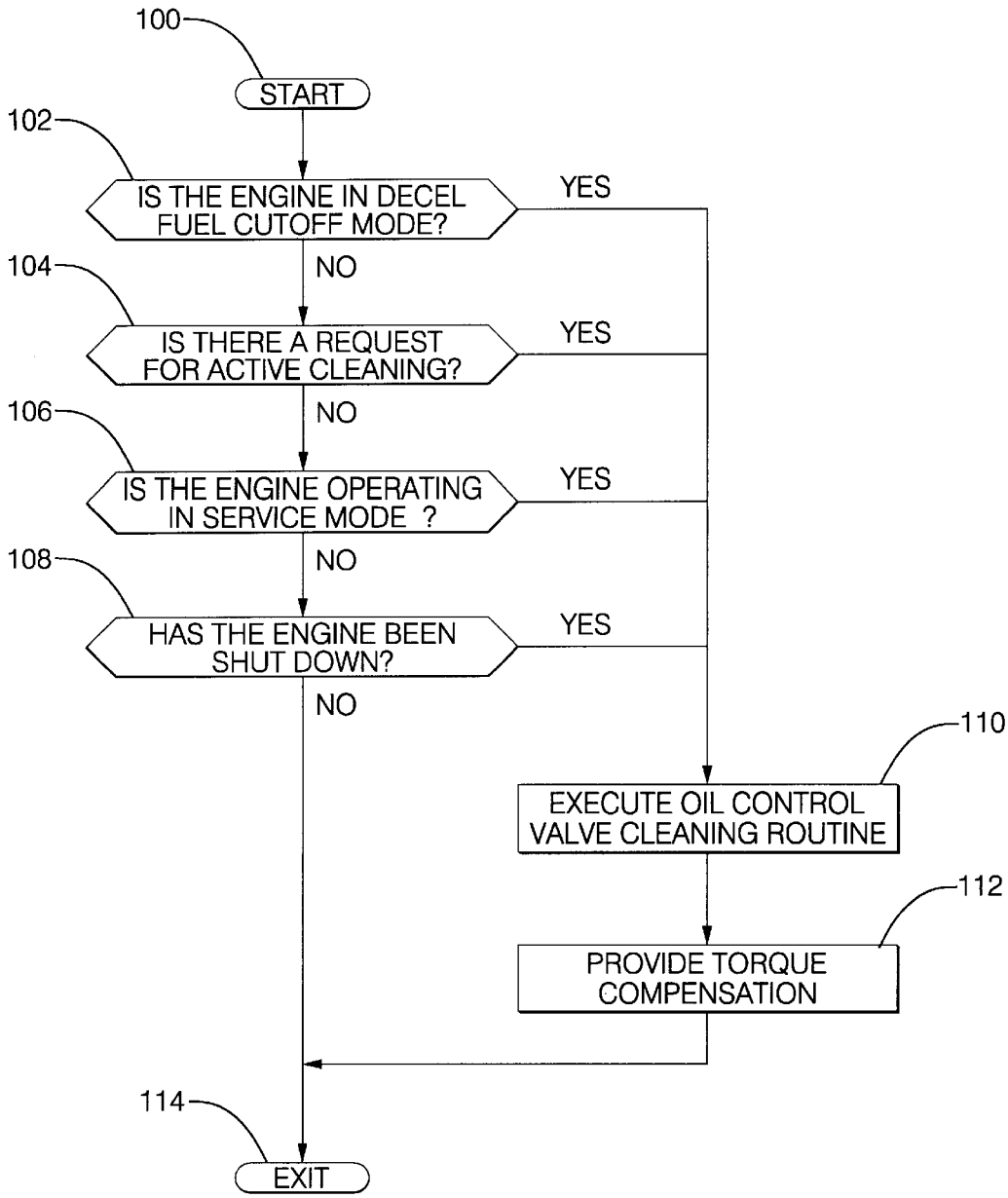
FIG. 3 is a method for controlling an oil control valve, in accordance with the present invention.

Referring now to FIG. 3, a method for removing contaminants from an oil control valve 12 for a variable cam phasing system is shown that comprises providing the internal combustion engine 5 with the variable cam phasing system as described in FIGS. 1 and 2. The method operates by determining that the internal combustion engine 5 is operating in a predetermined mode, and executing an oil control valve cleaning routine (step 110, shown if FIG. 3). The predetermined mode can be a predetermined engine operating condition (step 102), it can occur when a fault has been detected by the fault detection system (step 104), it can occur when there has been an external request for active cleaning (step 106), or it can occur when the engine 5 is being shutdown (step 108), or after the engine has been shutdown.

When the engine 5 is operating, the method will monitor engine operation to determine if the engine 5 is operating in a deceleration fuel cutoff mode (step 102). The deceleration fuel cutoff mode (step 102) is generally detected when the engine 5 is in a closed throttle maneuver. When the engine 5 is in a vehicle, it will coast down from some previously attained velocity when the operator demand discontinues. The controller 10 can then suspend fuel delivery to the engine 5 and use engine braking to assist in slowing the speed of the vehicle. In the present invention the method will detect the deceleration fuel cutoff mode by sensing engine operation using at least one sensor (not shown). The method will determine engine torque based upon the sensed engine operation and the operation of the fuel injection system. The method will determine that the engine 5 is in a deceleration fuel cutoff mode (step 102) when the engine torque is below a threshold value and the fuel injection system is not operating. The threshold value that will trigger a deceleration fuel cutoff mode is typically calibrated for engine torque values that are negative. One skilled in the art knows the calibration of engine parameters including determination of deceleration fuel cutoff mode. When the controller 10 has determined that the engine 5 is in a deceleration fuel cutoff mode, the oil control valve cleaning routine (step 110, shown in FIG. 3) will be executed.

When the engine 5 is running, various operating conditions will also be monitored using the fault detection system. Emissions calibration thresholds at which the fault detection system will signal to an operator that a fault has occurred in a specific component or system are determined based upon a correlation between the monitored operating condition and at least one of a group of regulated emissions constituents. A need for an active cleaning mode can be determined using the fault detection system for the variable cam phasing system. In the present embodiment, an active cleaning calibration threshold will be used to determine the need for the active cleaning mode. The active cleaning calibration threshold is set to be less than the emissions calibration threshold for the variable cam phasing system. The reason for setting a lower threshold for active cleaning is to permit the controller 10 to execute a preventative maintenance operation, i.e. the active cleaning mode, prior to detecting the presence of an emissions-related fault in the engine 5.

When the controller 10 has determined that an active cleaning calibration threshold has been exceeded, it can then enter a request for active cleaning mode (Step 104). The active cleaning mode is comprised of executing the oil control valve cleaning routine (step 110, shown if FIG. 3) during predetermined engine operating conditions. In this embodiment, the engine will need to be operating in a deceleration fuel cutoff mode and the engine speed will need to be above a predetermined threshold in order for the method to execute the active cleaning mode (step 104). The predetermined threshold will typically be a value above idle speed, and must be calibrated for each given engine configuration.

The method can also comprise maintaining engine torque during execution of the oil control valve cleaning routine (Step 112). This includes providing the engine control system with the electronic controller 10, the variable cam phasing system that includes an engine torque management system, and the fault detection system. When the fault detection system determines that the active cleaning calibration threshold has been exceeded, then the controller 10 can execute the oil control valve cleaning routine (step 110) while controlling engine torque with the engine torque management system. The engine torque management system will make the use of the oil control valve cleaning routine (step 110) unnoticeable to the operator.

If the root cause of a change in a monitored operating condition is that the oil control valve 12 has become contaminated, then the active cleaning mode may reduce or eliminate the source of the increase, and restore the oil control valve 12 to normal operation. If the root cause of a change in a monitored operating condition is that there is a fault in the variable cam phaser 14 system, then the fault detection system will continue to operate as intended and inform the operator of the presence of a fault only when the emissions calibration threshold has been exceeded.

When the engine 5 is running, the controller 10 will also be continually be monitoring for communication of control signals from an external device (step 106), such as a handheld scan tool (not shown), through the external communicator 11. A service person can use the scan tool in a service mode to communicate a request for cleaning to the controller 10. The request for cleaning mode is comprised of executing the oil control valve cleaning routine (step 110) when the engine is operating within predetermined conditions. This may comprise operating the engine at a selected speed at idle or above idle, and executing the cleaning routine. A service manual or engine test manual can inform the service person of the possibility of a possible change in performance. Thus an effect on engine performance due to such an intrusive action will be expected and not create a cause for alarm.

The request for cleaning mode may be performed during an engine build and test phase, during a vehicle assembly and test phase, or in response to a request for engine service. When the request for cleaning is completed by the service person as part of a service program it may be in response to a customer inquiry related to engine driveability concerns or the presence of an indication that a fault has been detected in the engine 5, e.g. an illuminated malfunction indicator lamp.

When the predetermined mode is that the engine 5 has been shutdown (step 108), or is being shutdown, the controller 10 can enter a request for cleaning mode. The shutdown mode is comprised of executing the oil control valve cleaning routine (step 110) during the period when the engine 5 is being shutdown or after the engine 5 has been shutdown, i.e. during an engine off condition.

Figure 4:
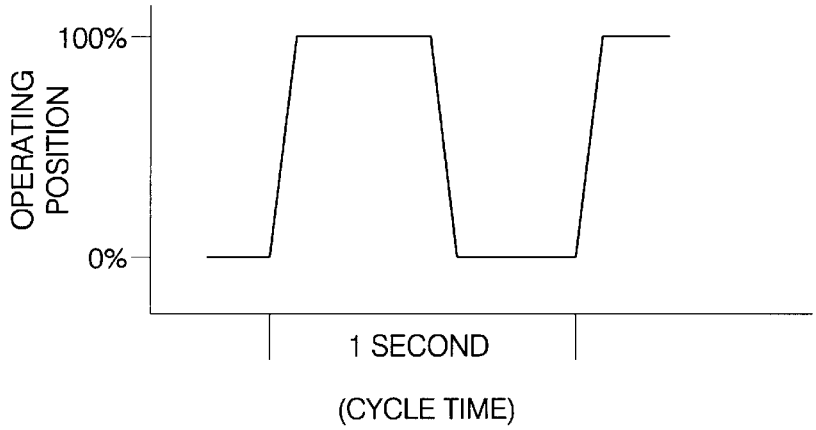
FIG. 4 is a graph, in accordance with the present invention.

The oil control valve cleaning routine (Step 110) is comprised of cycling the oil control valve 12 over its range of operating positions at least once. The operating positions can be described as ranging from a 0% position to a 100% position and is a description of movement of the armature (not shown) and attached spool 31 within the valve. This measure of operating positions corresponds to a range from a fully closed position to a fully opened position, as shown in the vertical scale in FIG. 4. A series of PWM signals 40 are sent from the controller 10 to the oil control valve 12 and cause the spool 31 to move from a fully opened position to a fully closed position, as shown in FIG. 4. The action of moving the spool 31 from the fully opened position to the fully closed position, coupled with the flow of oil through the valve 12 and over the spool 31 and valve body 33, will serve to remove contaminants that have become wedged or pinched between the spool 31 and valve body 33. The controller 10 may also choose to execute the oil control valve cleaning routine (step 110) multiple times during a given enablement period.

Although the invention is described as an oil control valve 12 for controlling flow of oil to a vane-type variable cam phaser 14, it is understood that alternate embodiments of this invention can include other actuators that are controlled by oil control valves. These actuators can include a spline-type phaser, a variable valve lift and duration control device, a variable valve-timing device, a cylinder deactivation device, among others. It is also understood that the invention encompasses other cleaning routines of oil control valves for use by internal combustion engines, such as a ramped change in position, or dithering, which is an induced oscillation of the spool 31 of the oil control valve 12 at a preset frequency and amplitude to remove grit.

The invention has been described with specific reference to the preferred embodiments and modifications thereto. Further modifications and alterations may occur to others upon reading and understanding the specification. It is intended to include all such modifications and alterations insofar as they come within the scope of the invention.

Having thus described the invention, it is claimed:

1. A method for removing contaminants from an oil control valve for use in an internal combustion engine, comprising providing an electronic controller that is connected to a fuel injection system, an oil control valve, at least one sensor, and an external communicator;

determining the internal combustion engine is operating in a predetermined mode using the electronic controller; and executing an oil control valve cleaning routine.

2. The method of claim 1, wherein determining the internal combustion engine is operating in a predetermined mode comprises determining that the internal combustion engine is operating in a deceleration fuel cutoff mode.

3. The method of claim 2, wherein determining that the internal combustion engine is operating in a deceleration fuel cutoff mode comprises sensing engine operation with the at least one sensor;

determining engine torque based upon the sensed engine operation;

determining that the engine torque is below a threshold value; and determining that the engine control system is not operating the fuel injection system.

4. The method of claim 1, wherein determining the internal combustion engine is operating in a predetermined mode comprises determining that the internal combustion engine is operating in a request for active cleaning mode.

5. The method of claim 4, wherein determining that the internal combustion engine is operating in a request for active cleaning mode comprises monitoring a fault detection system, and determining that an active cleaning calibration threshold has been exceeded, based upon the monitored fault detection system.

6. The method of claim 1, wherein determining that the internal combustion engine is operating in a predetermined mode comprises determining the internal combustion engine is operating in a service mode.

7. The method of claim 6, wherein determining that the internal combustion engine is operating in a service mode comprises monitoring the external communicator, and determining that a request for cleaning has been sent to the electronic controller from the external communicator.

8. The method of claim 1, wherein executing an oil control valve cleaning routine comprises cycling the oil control valve from a fully opened position to a fully closed position at least once.

9. The method of claim 1, wherein determining that the internal combustion engine is operating in a predetermined mode comprises determining that the internal combustion engine is shutting down.

10. The method of claim 1, wherein determining that the internal combustion engine is operating in a predetermined mode comprises determining that the internal combustion engine has been shut down.

11. The method of claim 1, wherein the oil control valve is operable to control a variable cam phaser.

12. A method for removing contaminants from an oil control valve for use in an internal combustion engine, comprising providing an electronic controller, a fuel injection system, and at least one sensor; wherein the electronic controller is operably connected to said fuel injection system, the oil control valve, and the at least one sensor;

determining engine torque based upon the at least one sensor;

monitoring operation of the fuel injection system using the electronic controller;

determining that the internal combustion engine is operating in a deceleration fuel cutoff mode based upon the engine torque and the operation of the fuel injection system; and executing an oil control valve cleaning routine.

13. The method of claim 12, wherein determining that the internal combustion engine is operating in a deceleration fuel cutoff mode based upon the monitored engine torque and the monitored operation of the fuel injection system comprises:

determining that the monitored engine torque is below a threshold, and determining that the engine control system is not operating the fuel injection system.

14. The method of claim 12, wherein executing an oil control valve cleaning routine comprises cycling the oil control valve from a fully opened position to a fully closed position at least once.

15. A method for removing contaminants from an oil control valve for use in an internal combustion engine, comprising providing the internal combustion engine including an electronic controller operably connected to an external communicator;

determining that the internal combustion engine is operating in a service mode; and executing an oil control valve cleaning routine.

16. The method of claim 15, wherein determining that the internal combustion engine is operating in a service mode comprises monitoring the external communicator, and determining that a request for cleaning has been sent to the electronic controller.

17. The method of claim 15, wherein executing an oil control valve cleaning routine comprises cycling the oil control valve from a fully opened position to a fully closed position at least once.

18. A method for maintaining engine torque during execution of an oil control valve cleaning routine for use in an internal combustion engine, comprising:

providing an engine torque management system and a fault detection system;

determining that an active cleaning calibration threshold has been exceeded using the fault detection system;

cycling the oil control valve from a fully opened position to a fully closed position at least once; and controlling engine torque using the engine torque management system.

19. A controller for an oil control valve for use in an internal combustion engine:

wherein the controller determines the internal combustion engine is operating in a predetermined mode based upon input from a fuel injection system, at least one sensor and an external communicator; and the controller executes an oil control valve cleaning routine based upon the predetermined mode.

20. A method for cleaning contaminants from an oil control valve in an engine comprising providing at least one sensor to monitor engine operation;

determining engine torque based upon the at least one monitored engine operation;

determining whether the engine torque is within a predetermined mode;

sending a cleaning signal to said oil control valve when said engine torque is within said predetermined mode; and moving the oil control valve from a fully open position to a fully closed position upon receipt of said cleaning signal.

21. The method in claim 20, wherein the predetermined mode is a deceleration fuel cutoff mode.

22. The method in claim 20, wherein the predetermined mode is a request for active cleaning mode.

23. The method in claim 20, wherein the predetermined mode is a service mode.

24. The method in claim 20, wherein the predetermined mode is an engine shutdown mode.

25. The method in claim 20, wherein the predetermined mode is an engine shutoff mode.

* * * * *